US010460702B2

(12) United States Patent
Kanovsky et al.

(10) Patent No.: US 10,460,702 B2
(45) Date of Patent: Oct. 29, 2019

(54) DISPLAY PIXEL OVERDRIVE SYSTEMS AND METHODS

(71) Applicant: Apple Inc., Cupertino, CA (US)

(72) Inventors: Nachum M. Kanovsky, Sunnyvale, CA (US); Marc Albrecht, San Francisco, CA (US); Tobias Jung, San Francisco, CA (US); Xiaokai Li, Sunnyvale, CA (US); Ameya Y. Joshi, Menlo Park, CA (US)

(73) Assignee: Apple Inc., Cupertino, CA (US)

( * ) Notice: Subject to any disclaimer, the term of this patent is extended or adjusted under 35 U.S.C. 154(b) by 6 days.

(21) Appl. No.: 15/691,687

(22) Filed: Aug. 30, 2017

(65) Prior Publication Data

US 2018/0374450 A1 Dec. 27, 2018

Related U.S. Application Data

(60) Provisional application No. 62/525,672, filed on Jun. 27, 2017.

(51) Int. Cl.
*G09G 5/10* (2006.01)
*G09G 5/393* (2006.01)
(Continued)

(52) U.S. Cl.
CPC ..... *G09G 5/10* (2013.01); *G09G 3/2062* (2013.01); *G09G 3/3607* (2013.01); *G09G 5/393* (2013.01);
(Continued)

(58) Field of Classification Search
CPC ..... G09G 5/10; G09G 3/3607; G09G 5/393; G09G 2340/16; G09G 2310/08;
(Continued)

(56) References Cited

U.S. PATENT DOCUMENTS 5,758,091 A * 5/1998 Hannah ..... H04N 5/20 348/E5.073
2004/0146202 A1* 7/2004 Hyoki ..... G06T 3/0006 382/209
(Continued)

*Primary Examiner* — Ke Xiao
*Assistant Examiner* — Kim Thanh T Tran
(74) *Attorney, Agent, or Firm* — Jaffery Watson Mendonsa & Hamilton LLP

(57) ABSTRACT

Aspects of the subject technology relate to display circuitry including pixel overdrive circuitry. The pixel overdrive circuitry includes a compression engine that compresses a previous display frame, for storage and comparison to a current display frame without compression or decompression of the current display frame. The compression engine compresses the previous frame in such a way that the maximum compression error is always known and can be used to determine whether to perform overdrive operations for the current frame without compressing and decompressing the current display frame. The compression engine selects gradient encoding or decimation encoding for the compression of the previous display frame and can perform successive decimation operations within the gradient encoding operations to help reduce the size of the compressed previous frame while maintaining the quality of the ultimate overdriven current frame.

24 Claims, 7 Drawing Sheets

(51) Int. Cl.

| | |
|---|---|
| ***G09G 3/36*** | (2006.01) |
| ***G09G 3/20*** | (2006.01) |
| ***G09G 5/395*** | (2006.01) |
| ***G09G 5/36*** | (2006.01) |

(52) U.S. Cl.
CPC ..... *G09G 5/395* (2013.01); *G09G 5/363* (2013.01); *G09G 2310/08* (2013.01); *G09G 2320/0233* (2013.01); *G09G 2320/0242* (2013.01); *G09G 2320/0252* (2013.01); *G09G 2320/103* (2013.01); *G09G 2340/02* (2013.01); *G09G 2340/16* (2013.01); *G09G 2360/08* (2013.01); *G09G 2360/122* (2013.01); *G09G 2360/16* (2013.01); *G09G 2360/18* (2013.01)

(58) Field of Classification Search
CPC ..... G09G 2320/0242; G09G 2360/18; G09G 2360/122; G09G 5/363; G09G 2320/0233; G09G 2340/02; G09G 5/395; G09G 3/2062; G09G 2360/08; G09G 2320/103; G09G 2320/0252; G09G 2360/16
USPC ..... 345/545
See application file for complete search history.

(56) References Cited

U.S. PATENT DOCUMENTS

2006/0222218 A1* 10/2006 Karaki ..... G06K 9/0002 382/124
2008/0270441 A1* 10/2008 Eke ..... G06F 1/035
2009/0021499 A1* 1/2009 Chen ..... G09G 3/3648 345/204
2010/0158104 A1* 6/2010 Lin ..... H04N 19/61 375/240.2
2013/0002618 A1* 1/2013 Furihata ..... G09G 5/363 345/204
2013/0169703 A1* 7/2013 Mizusako ..... G09G 5/10 345/691
2016/0165231 A1* 6/2016 Shieh ..... H03M 7/6064 382/239

* cited by examiner

DISPLAY PIXEL OVERDRIVE SYSTEMS AND METHODS

CROSS-REFERENCE TO RELATED APPLICATIONS

The present application claims the benefit of U.S. Provisional Patent Application Ser. No. 62/525,672 entitled "DISPLAY PIXEL OVERDRIVE SYSTEMS AND METHODS," filed on Jun. 27, 2017, which is hereby incorporated by reference in its entirety for all purposes.

TECHNICAL FIELD

The present description relates generally to electronic devices with displays, and more particularly, but not exclusively, to pixel overdrive systems and methods for electronic device displays.

BACKGROUND

Electronic devices such as computers, media players, cellular telephones, set-top boxes, and other electronic equipment are often provided with displays for displaying visual information. Displays such as organic light-emitting diode (OLED) displays and liquid crystal displays (LCDs) typically include an array of display pixels arranged in pixel rows and pixel columns. Liquid crystal displays commonly include a backlight unit and a liquid crystal display unit with individually controllable liquid crystal display pixels.

When time-varying content such as video content or user-modified content is displayed, particularly content in which particular pixel brightnesses vary between grey levels from display frame to display frame, undesirable visible display artifacts can arise. For example, when a particular pixel is changed in brightness from one grey level to another grey level, a delay in reaching the new grey level can cause an undesirable visible effect on the display. These undesirable visible effects can include visible tails when scrolling text on a soft temperature background or motion blur during fast motion video scenes.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

Figure 1:
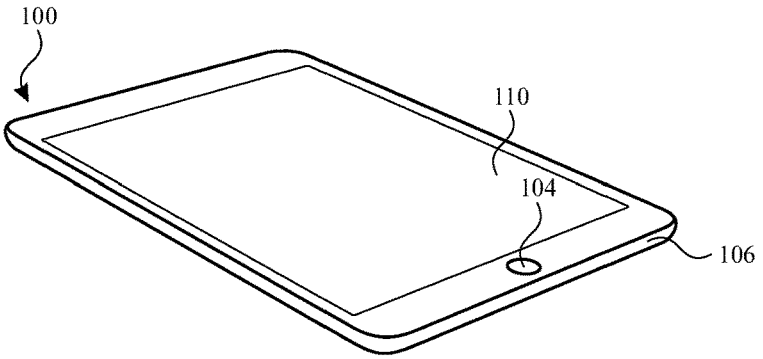
FIG. 1 illustrates a perspective view of an example electronic device having a display in accordance with various aspects of the subject technology.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

The subject disclosure provides electronic devices such as cellular telephones, media players, computers, set-top boxes, wireless access points, and other electronic equipment that may include displays. Displays may be used to present visual information and status data and/or may be used to gather user input data. A display may include an array of display pixels. Each display pixel may include one or more colored subpixels for displaying color images. For example, each display pixel may include a red subpixel, a green subpixel, and blue subpixel. It should be appreciated that, although the description that follows often describes operations associated with a display pixel, in implementations in which each display pixel includes multiple subpixels, the circuitry and operations described herein can be applied and/or performed, per color, for each subpixel of the display pixel.

Each display pixel may include a layer of liquid crystals disposed between a pair of electrodes operable to control the orientation of the liquid crystals. Controlling the orientation of the liquid crystals by modifying a voltage difference across the electrodes controls the polarization of backlight. This polarization control, in combination with polarizers on opposing sides of the liquid crystal layer, allows light passing into the pixel to be manipulated to selectively block the light or allow the light to pass through the pixel.

Digital grey levels for operating display pixels can have associated values from, for example, 0 to 255. Due to properties inherent in liquid crystals, although a change from a grey level of zero to a grey level of 255 can be achieved relatively quickly by applying a voltage corresponding to the 255 grey level to the pixel, a change from, for example, 0 to 127 can include a delay that can have visible effects on the display.

In order to prevent these artifacts, in some situations described hereinafter in further detail, the display pixels can be briefly overdriven to a brightness level beyond the desired brightness level of the new frame (e.g., by driving the pixel electrodes to a voltage beyond that corresponding to the desired digital grey level), to move the pixel to the new brightness level more quickly. However, in some implementations, pixel overdrive systems can require an undesirably large (and thus expensive) frame buffer to store a previous display frame for comparison to the current display frame. In other implementations, both the current frame and the previous frame are compressed and decompressed to reduce the storage needs for storing the previous frame. However, in many of these implementations, the current frame must also be decompressed, during boost operations for that frame, in order to compare the previous frame decompression errors with the current frame decompression errors so that these implementations can detect static frames that might have artifacts from the compression causing a mistaken identification of the current frame being different from the previous frame. However, compression effects from using a decompressed current frame for boost operations for that frame can also propagate to the displayed images, causing undesirable artifacts such as banding, color shifts and/or shimmering.

In accordance with some aspects of the subject disclosure, which are described in further detail hereinafter, systems and methods for compression of the previous frame (e.g., a preceding display frame to a current display frame) are provided that reduce the storage requirements of the frame buffer (e.g., by a ratio of as much as, or more than 13:1) and avoid undesirable artifacts such as banding, color shifts and/or shimmering. The compression systems and methods disclosed herein employ a unique combination of decimation and gradient encoding in which the maximum possible compression error for the current frame is already known and thus (although the current frame is compressed for use as the previous frame in boost operations for a subsequent frame), the current frame is never decompressed during boost operations for that current frame.

The combination of gradient and decimation compression operations disclosed herein are particularly unique, in part because the goals of the image compression for overdrive operations are different from those of a standard image compression operation. In a standard image compression operation, the quality of an ultimately decompressed frame is the driving goal. However, in the pixel overdrive operations described herein, the quality of the decompressed frame is secondary to the quality of the overdriven output, which is not necessarily correlated to the compressed/decompressed frame quality. In one aspect, gradient compression is emphasized throughout the compression operations for various tiles of the previous frame to, for example, reduce banding artifacts in the overdriven current frame.

Moreover, the compression operations described herein are performed using tiles of pixels that each form a subarray of the total array of pixel values for a corresponding display frame. Accordingly, the compression operations described herein prevent propagation of compression errors in one tile from affecting overdrive operations for any other tile.

An illustrative electronic device of the type that may be provided with a display is shown in FIG. 1. In the example of FIG. 1, device 100 has been implemented using a housing that is sufficiently small to be portable and carried by a user (e.g., device 100 of FIG. 1 may be a handheld electronic device such as a tablet computer or a cellular telephone). As shown in FIG. 1, device 100 may include a display such as display 110 mounted on the front of housing 106. Display 110 may be substantially filled with active display pixels or may have an active portion and an inactive portion. Display 110 may have openings (e.g., openings in the inactive or active portions of display 110) such as an opening to accommodate button 104 and/or other openings such as an opening to accommodate a speaker, a light source, or a camera.

Display 110 may be a touch screen that incorporates capacitive touch electrodes or other touch sensor components or may be a display that is not touch-sensitive. Display 110 may include display pixels formed from light-emitting diodes (LEDs), organic light-emitting diodes (OLEDs), plasma cells, electrophoretic display elements, electrowetting display elements, liquid crystal display (LCD) components, or other suitable display pixel structures. Arrangements in which display 110 is formed using LCD pixels and LED backlights are sometimes described herein as an example. This is, however, merely illustrative. In various implementations, any suitable type of display technology may be used in forming display 110 if desired.

Housing 106, which may sometimes be referred to as a case, may be formed of plastic, glass, ceramics, fiber composites, metal (e.g., stainless steel, aluminum, etc.), other suitable materials, or a combination of any two or more of these materials.

The configuration of electronic device 100 of FIG. 1 is merely illustrative. In other implementations, electronic device 100 may be a computer such as a computer that is integrated into a display such as a computer monitor, a laptop computer, a somewhat smaller portable device such as a wrist-watch device, a pendant device, or other wearable or miniature device, a media player, a gaming device, a navigation device, a computer monitor, a television, or other electronic equipment.

For example, in some implementations, housing 106 may be formed using a unibody configuration in which some or all of housing 106 is machined or molded as a single structure or may be formed using multiple structures (e.g., an internal frame structure, one or more structures that form exterior housing surfaces, etc.). Although housing 106 of FIG. 1 is shown as a single structure, housing 106 may have multiple parts. For example, housing 106 may have upper portion and lower portion coupled to the upper portion using a hinge that allows the upper portion to rotate about a rotational axis relative to the lower portion. A keyboard such as a QWERTY keyboard and a touch pad may be mounted in the lower housing portion, in some implementations.

In some implementations, electronic device 100 may be provided in the form of a computer integrated into a computer monitor. Display 110 may be mounted on a front surface of housing 106 and a stand may be provided to support housing (e.g., on a desktop).

Figure 2:
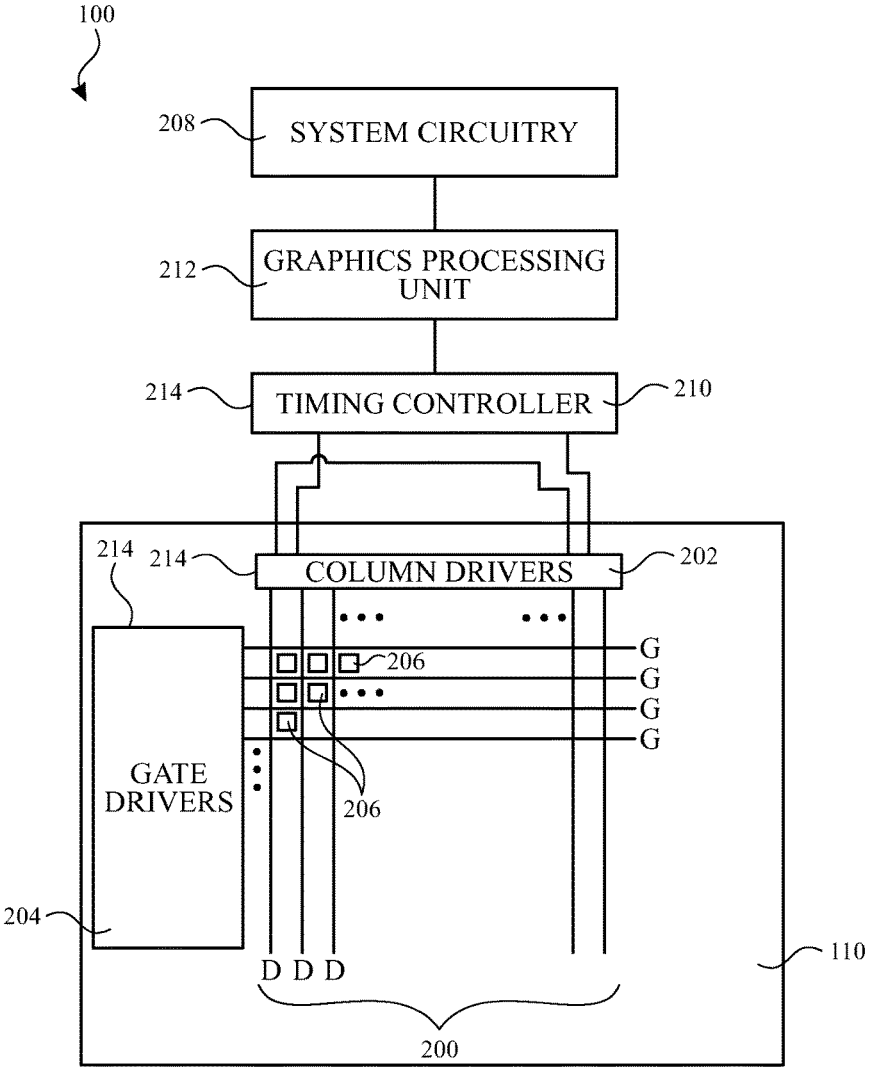
FIG. 2 illustrates a schematic diagram of exemplary display circuitry in accordance with various aspects of the subject technology.

FIG. 2 is a schematic diagram of device 100 showing illustrative circuitry that may be used in displaying images for a user of device 100 on pixel array 200 of display 110. As shown in FIG. 2, display 110 may include column driver circuitry 202 that drives data signals (analog voltages) onto the data lines D of array 200. Gate driver circuitry 204 may drive gate line signals onto gate lines G of array 200.

Using the data lines D and gate lines G, display pixels 206 may be operated to display images on display 110 for a user. In some implementations, gate driver circuitry 204 may be implemented using thin-film transistor circuitry on a display substrate such as a glass or plastic display substrate or may be implemented using integrated circuits that are mounted on the display substrate or attached to the display substrate by a flexible printed circuit or other connecting layer. In some implementations, column driver circuitry 202 may be implemented using one or more column driver integrated circuits that are mounted on the display substrate or using column driver circuits mounted on other substrates.

Device 100 may include system circuitry 208. System circuitry 208 may include one or more different types of storage such as hard disk drive storage, nonvolatile memory (e.g., flash memory or other electrically-programmable-read-only memory), volatile memory (e.g., static or dynamic random-access-memory), magnetic or optical storage, permanent or removable storage and/or other non-transitory storage media configure to store static data, dynamic data, and/or computer readable instructions for processing circuitry in system circuitry 208. Processing circuitry in system circuitry 208 may be used in controlling the operation of device 100. Processing circuitry in system circuitry 208 may sometimes be referred to herein as system circuitry or a system-on-chip (SOC) for device 100.

The processing circuitry may be based on a processor such as a microprocessor and other suitable integrated circuits, multi-core processors, one or more application specific integrated circuits (ASICs) or field programmable gate arrays (FPGAs) that execute sequences of instructions or code, as examples. In one suitable arrangement, system circuitry 208 may be used to run software for device 100, such as interne browsing applications, email applications, media playback applications, operating system functions, software for capturing and processing images, software implementing functions associated with gathering and processing sensor data, software that makes adjustments to display brightness and touch sensor functionality, etc.

During operation of device 100, system circuitry 208 may produce data that is to be displayed on display 110. This display data may be provided to display control circuitry such as graphics processing unit (GPU) 212. For example display frames for display using pixels 206 may be provided from system circuitry 208 to GPU 212. GPU 212 may process the display frames and provide processed display frames to timing controller integrated circuit 210.

Timing controller 210 may provide digital display data to column driver circuitry 202 using paths 216. Column driver circuitry 202 may receive the digital display data from timing controller 210. Using digital-to-analog converter circuitry within column driver circuitry 202, column driver circuitry 202 may provide corresponding analog output signals on the data lines D running along the columns of display pixels 206 of array 200.

Graphics processing unit 212 and timing controller 210 may sometimes collectively be referred to herein as display control circuitry 214. Display control circuitry 214 may be used in controlling the operation of display 110. Display control circuitry 214 may sometimes be referred to herein as a display driver, a display controller, a display driver integrated circuit (IC), or a driver IC. Graphics processing unit 212 and timing controller 210 may be formed in a common package (e.g., an SOC package) or may be implemented separately (e.g., as separate integrated circuits). In some implementations, timing controller 210 may be implemented separately as a display driver, a display controller, a display driver integrated circuit (IC), or a driver IC that receives processed display data from graphics processing unit 212. Accordingly, in some implementations, graphics processing unit 212 may be considered to be part of the system circuitry (e.g., together with system circuitry 208) that provides display data to the display control circuitry (e.g., implemented as timing controller 210, gate drivers 204, and/or column drivers 202). Although a signal gate line G and a single data line D for each pixel 206 are illustrated in FIG. 2, this is merely illustrative and one or more additional row-wise and/or column-wise control lines may be coupled to each pixel 206 in various implementations.

Figure 3:
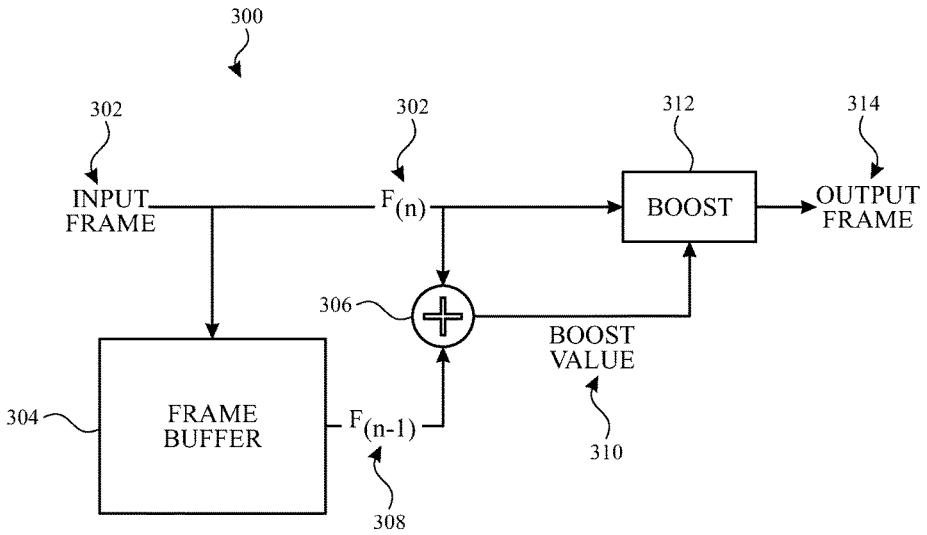
FIG. 3 illustrates a flow diagram for pixel overdrive circuitry in accordance with various aspects of the subject technology.

Graphics processing unit 212 and/or system circuitry 208 includes pixel overdrive circuitry, sometimes referred to as display overdrive circuitry. One example implementation of pixel overdrive circuitry that may be implemented in, for example, GPU 212 is shown in FIG. 3. As shown in FIG. 3, pixel overdrive circuitry 300 includes frame buffer 304, comparator 306, and boost engine 312. An input frame such as input frame 302 may be received by pixel overdrive circuitry 300 (e.g., from system circuitry 208). Input frame 302 may be a current frame for display and may be referred to as an $n^{th}$ frame or frame $F_{(n)}$.

As shown in FIG. 3, in order to overdrive the pixels (or subpixels) of the current frame, the current frame may be compared with a previous $(n-1)^{th}$ frame 308, referred to as frame $F_{(n-1)}$, using comparator 306. Comparator 306 may determine a difference between current frame 302 and previous frame 308 and identify boost value 310 based on the difference. Boost value 310 may be added to current frame 302 by boost engine 312 to generate output frame 314. Output frame 314 may be provided to, for example, timing controller 210 for display using pixels 206.

However, in the example of FIG. 3, frame buffer 304 stores the entire previous frame 308. To store the entire frame, the frame buffer may require a relatively large amount of silicon chip area, which can be undesirably expensive.

Figure 4:
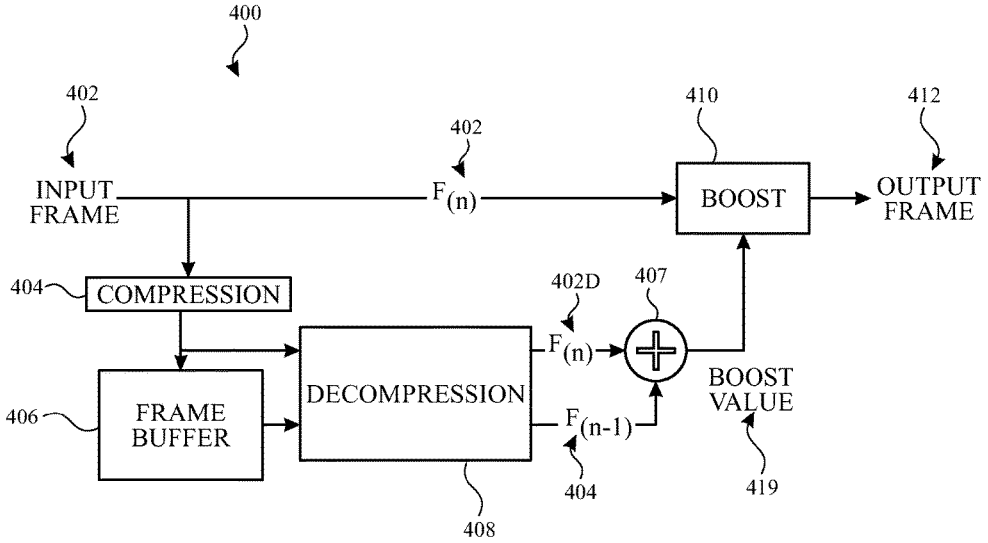
FIG. 4 illustrates a flow diagram for another implementation of pixel overdrive circuitry in accordance with various aspects of the subject technology.

In order to reduce the size of the frame buffer for pixel overdrive operations, in some implementations, the previous frame can be compressed as shown in FIG. 4. In the example of FIG. 4, pixel overdrive circuitry 400 includes a smaller frame buffer 406 (relative to frame buffer 304, noting that the size of the frame buffers in FIGS. 3 and 4 are representative and are not drawn to scale) that stores a compressed previous frame $F_{(n-1)}$. However, in order to ensure that compression errors in the compression of the previous frame do not propagate to become a part of a boost value, current frame 402 is also compressed. Then, decompression engines 408 (including one decompression engine for each of the compressed current frame and the compressed previous frame) decompress the compressed current frame and the compressed previous frame to generate a decompressed version 402D of current frame 402 and a decompressed version 404 of previous frame $F_{(n-1)}$. Boost value 419 is then generated based on the difference (determined by comparator 407) between the decompressed version 402D of current frame 402 and decompressed version 404 of previous frame $F_{(n-1)}$ for generation of the output frame 412 by boost engine 410.

However, compression and decompression of the current frame to determine a boost value as in the example of FIG. 4 can cause visible artifacts to be generated by the boost value. These visible artifacts can include banding, color shifts, and/or shimmering.

Figure 5:
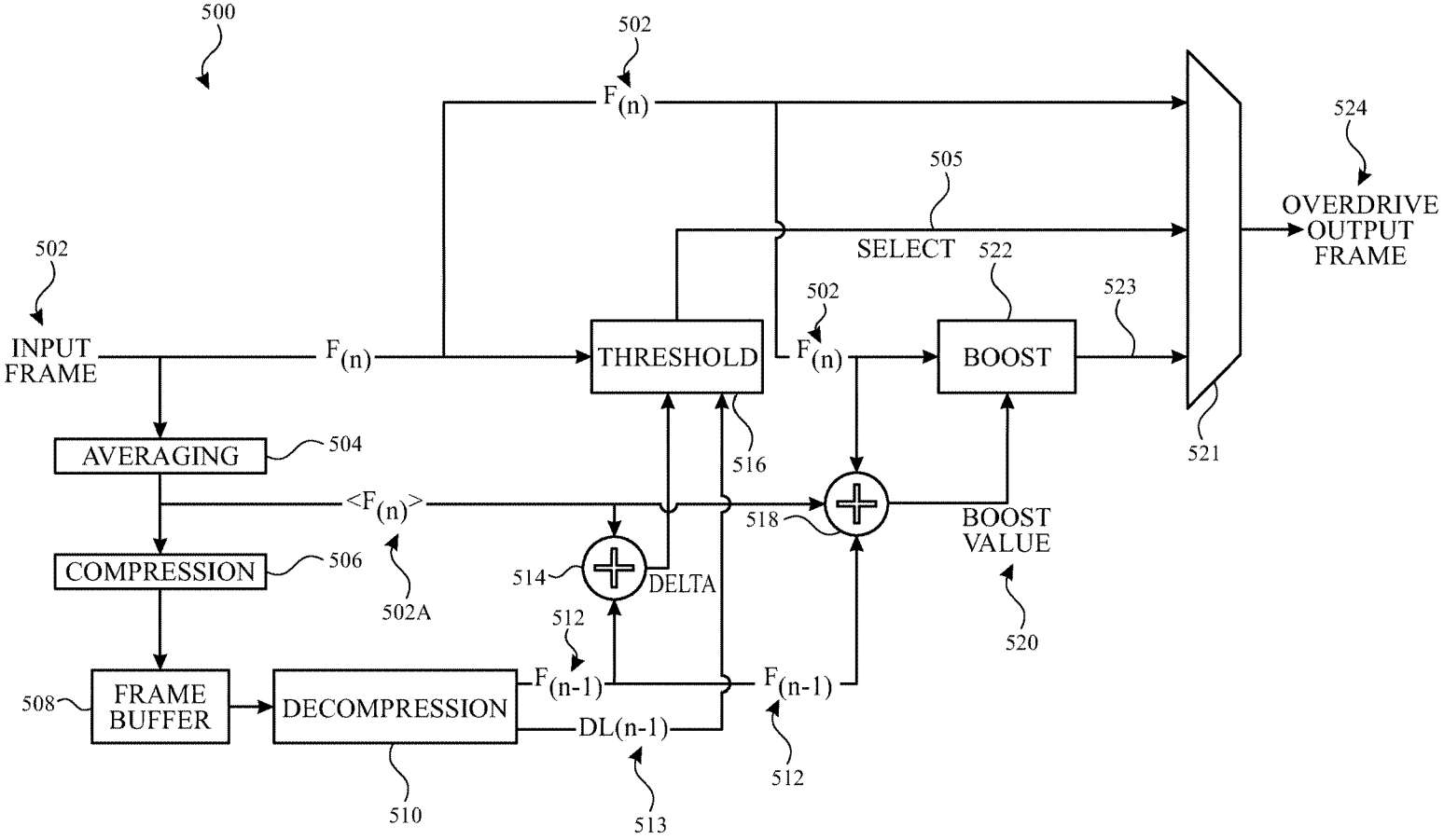
FIG. 5 illustrates a flow diagram for another implementation of pixel overdrive circuitry in accordance with various aspects of the subject technology.

FIG. 5 shows an implementation of pixel overdrive circuitry 500 (e.g., that can be implemented in graphics processing unit 212) that avoids decompression of the current frame for overdrive operations for the current frame, and that employs a reduced size frame buffer (e.g., even in comparison with frame buffer 406) for storing a compressed previous frame. For example, frame buffer 406 may store a compressed previous frame that has been compressed by a 7:1 ratio in comparison with frame buffer 508 which may store a compressed previous frame that has been compressed by as much as, or more than an approximately 13:1 ratio. As shown in FIG. 5, pixel overdrive circuitry 500 includes averaging engine 504, compression engine 506, frame buffer 508, decompression engine 510, comparator 514, threshold engine 516, comparator 518, multiplexer 521, and boost engine 522.

An input frame such as input frame 502 may be received by pixel overdrive circuitry 500 (e.g., from system circuitry 208). Input frame 502 may be a current frame for display and may be referred to as an $n^{th}$ frame or frame $F_{(n)}$. Each display frame includes an array of display pixel values. Each display pixel value may correspond to a single pixel value or may include multiple subpixel values. For some portions of the processes of pixel overdrive circuitry 500, input frame 502 is processed on a tile-by-tile basis, in which each of several tiles of pixel values in the current frame are processed individually. Each tile of pixel values includes a sub-array of the entire array of display pixel values of input frame 502. In one suitable implementation that is discussed herein as an example, each tile includes a sub-array of 8-by-8 display pixel values or a sub-array of 8-by-8 subpixel values (in implementations in which each display pixel includes multiple subpixel values). For example, in implementations in which each display pixel includes three color subpixels, an 8-by-8 tile of subpixels is provided for each of the three colors. The 8-by-8 tile of subpixels for each of the three colors is a subarray of the subpixel values, for that color, for the entire display frame.

In order to overdrive the pixels of current frame 502, current frame 502 is provided to averaging engine 504, threshold engine 516, comparator 518, and multiplexer 521. Averaging engine 504 averages the pixel values of current frame 502 to generate an average current frame 502A in which each two-by-two block of pixel values (or subpixel values) in each tile are averaged to a single value. In implementations in which each pixel includes multiple subpixels, this two-by-two averaging is performed for sets of two-by-two subpixels such that the result of averaging a two-by-two group of pixels, with three subpixels each, is one averaged pixel block value that includes three averaged subpixel block values. Averaging engine 504 may include a line buffer for averaging the two-by-two blocks. Averaging pixel values or subpixel values is distinguished herein from compression of pixel values or subpixel values in that averaging includes combining the values of multiple pixels or subpixels to generate a single value and compression includes encoding a single pixel value or a single subpixel block value by reducing the number of bits used to indicate that single value.

Current frame 502 is compressed, after averaging, by compression engine 506 on a tile-by-tile basis and the compressed tiles of current frame 502 are stored in frame buffer 508. Storing the compressed tiles of current frame 502 includes replacing the compressed tiles of previous frame $F_{(n-1)}$ with the compressed tiles of the current frame, to be used by overdrive operations for a subsequent frame. In an example in which each pixel includes multiple subpixels, during compression of current frame 502, the compressed averaged subpixel block values of compressed previous frame $F_{(n-1)}$ that are stored in frame buffer 508 are read out and decompressed using decompression engine 510 to form averaged subpixel block values of decompressed previous frame 512. Each averaged subpixel block value of decompressed previous frame 512 is compared, by comparator 514, with the corresponding averaged subpixel block value of averaged current frame 502A (referred to in FIG. 5 as $<F_{(n)}>$) without compression or decompression of the averaged current frame (e.g., by subtracting the averaged subpixel block values of decompressed previous frame 512 from the corresponding averaged subpixel block values of averaged current frame 502A).

The difference "Delta" between each averaged subpixel block value of decompressed previous frame 512 and the corresponding averaged subpixel block value of averaged current frame 502A is compared, by threshold engine 516, to an error threshold that is specific to the particular line of the particular tile in which the averaged subpixel block value of the decompressed previous frame is located. More specifically, the error threshold for each line of each tile is the known maximum compression error for that line of that tile, based on the known encoding style 513 (e.g., the known decimation level DL(n−1)) that was used for that line of that tile of the previous frame. The encoding style 513 may be provided from decompression engine 510 to threshold engine 516 for thresholding operations.

Threshold engine 516 outputs a Select signal 505 based on whether Delta is less than the threshold or greater than the threshold. If Delta is less than the threshold, threshold engine 516 determines that the change in the content of the subpixel values of the averaged subpixel block of the current frame 502 relative to the content of the corresponding subpixel values of the previous frame $F_{(n-1)}$ is zero or small (e.g., because substantially all of the Delta may be attributable errors caused by the compression/decompression of the previous frame) and a select signal 505 is generated that indicates to multiplexer 521 that those subpixel values of the unchanged current frame 502 are to be output from multiplexer 521 for a corresponding pixel of an overdrive output frame 524 (without any overdrive boost to those subpixels).

If Delta is greater than the threshold for an averaged subpixel block, threshold engine 516 determines that overdrive should be applied to the subpixels of that averaged subpixel block and a select signal 505 is generated that indicates to multiplexer 521 that boosted subpixel values 523 are to be output from multiplexer 521 for a corresponding pixel of overdrive output frame 524 for the subpixels in that averaged subpixel block. In this way, threshold engine 516 determines whether to overdrive each subpixel of current display frame 502 based on a known maximum compression error for a corresponding line of a corresponding tile of a compressed previous display frame, and based on a comparison of the averaged subpixel block for that subpixel in the current display frame 502 to a decompressed version 512 of the averaged subpixel block for that subpixel in the compressed previous display frame.

Pixel overdrive circuitry 500 computes and applies a boost value 520 for each subpixel to generate the pixels of an overdriven output frame 524 (e.g., each pixel including multiple overdriven output frame subpixels). More specifically, decompressed previous frame $F_{(n-1)}$ and current frame 502 are provided to comparator 518. As shown, averaged current frame 502A can also be provided to comparator 518. For each subpixel of current frame 502, comparator 518 computes a difference between that subpixel of current frame 502 (which has not been compressed or decompressed for the overdrive operations for that current frame) and the corresponding averaged subpixel block of decompressed previous frame 512, and determines a boost value 520 for that subpixel based on the difference. Boost value 520 is provided, along with current frame 502 (which has not been compressed or decompressed for the overdrive operations for that current frame) to boost engine 522.

Boost value 520 is dependent on the result of the comparison by comparator 518 and can be determined, for example, using a lookup table as described in further detail hereinafter (e.g., in connection with FIG. 13). Boost engine 522 adds boost value 520 to the corresponding subpixel value of current frame 502 to generate an overdriven output frame subpixel 523. Overdriven output frame subpixel 523 is generated by applying boost values 520 to the current display frame subpixels, where each boost value 520 is based on a comparison of a subpixel value of the current display frame 502 to the corresponding averaged subpixel block value of the decompressed version 512 of the compressed previous display frame without compressing or decompressing the current display frame tile.

By providing averaged current frame 502A to comparator 518, enhanced boost operations can be performed in some implementations. For example, each subpixel of current frame 502 can also be compared to the value of the averaged subpixel block for that subpixel in the current frame to determine whether the averaged subpixel block value for that subpixel is very different from the actual value of that subpixel (e.g., 3-sigma different, 5-sigma different, 10-sigma different, etc.). If the averaged subpixel block value for that subpixel is very different from the actual value of that subpixel, additional or different thresholding and/or boosting can be applied for that subpixel. In this way, errors due to averaging of neighboring subpixels with large differences can be avoided or reduced. In some scenarios, the decimation level DL(n−1) may also be provided to boost engine 522 (e.g., for sloping operations).

Overdriven output frame subpixel 523 is then included in a corresponding pixel of overdrive output frame 524, if select signal 505 indicates that the Delta for the average subpixel block for that subpixel in the current display frame 502 is greater than the threshold for that tile. In this way, pixel overdrive circuitry generates an overdrive output frame 524 that includes pixel values with no overdrive (for pixels with Delta<Thresh subpixels) and pixel values with overdrive applied (for pixels with Delta>Thresh subpixels). Overdrive output frame 524 may be provided to, for example, timing controller 210 for display using pixels 206.

It should be appreciated that overdrive circuitry 500 can be provided with only a single decompression engine 510 (for the compressed previous frame) and thresholding operations of threshold engine 516 can be performed, for the current display frame, without compression and decompression of the current frame, because of the unique operations of compression engine 506. In particular, the unique operations of threshold engine 516 generate a compressed previous frame with a maximum possible compression error that is known a priori by threshold engine for each line of tile for each frame.

The threshold "Thresh" used by threshold engine 516 for each subpixel block in each line of each tile of the current frame is the known maximum compression error for the corresponding line of the corresponding tile of the previous frame. If threshold engine 516 determines that the actual difference between the corresponding averaged subpixel blocks of the two frames (current and previous) exceeds the known maximum possible error caused by the compression of the previous frame, threshold engine 516 determines that a difference in the content of the subpixel blocks has occurred and a boost (overdrive) should be applied to the subpixels of that subpixel block of the current frame. If threshold engine 516 determines that the actual difference between the corresponding subpixel blocks of the two frames (current and previous) is less than or equal to the maximum possible error caused by the compression of the previous frame, threshold engine 516 determines that no substantial change in content of the subpixel block has occurred from frame to frame and overdrive (e.g., boost engine 522) is bypassed for the subpixels of that that subpixel block.

It should also be appreciated that other arrangements for overdrive circuitry 500 are contemplated. For example, in some configurations, the select signal 505 from threshold engine 516 may be used, when it is determined that no boost should be applied for a particular subpixel of the current display frame, to prevent the operations of comparator 518 and boost engine 522 so that no overdriven subpixel 523 is generated from that pixel.

The unique compression operations of compression engine 506 will now be described with particular reference to an exemplary scenario in which 8 pixel by 8 pixel tiles each having 10 bits per color are compressed, noting that overdrive operations can run in 8 bits when the pixel values are have a different number of bits (e.g., if the pixel vales are in 9, 10 or more bits, the pixel values can be rounded down to 8 bits and the overdrive boost value can then be multiplied back up to the original number of bits and applied/added to the relevant current frame values). In this example, using the compression operations described below, a frame buffer 508 having a storage size of less than, for example, 40 megabits (e.g., 33 megabits) can be used to store a compressed previous frame for use in generating the overdrive output frame for the current display frame even for a 15 Megapixel display frame, each having three colors encoded with ten bits per color. Accordingly, a frame buffer implemented in a relatively smaller amount of silicon can be used. However, it should be appreciated that this example scenario is merely illustrative and the compression operations described can be scaled to other tile sizes, display frame sizes, and/or other bit depths if desired.

Figure 6:
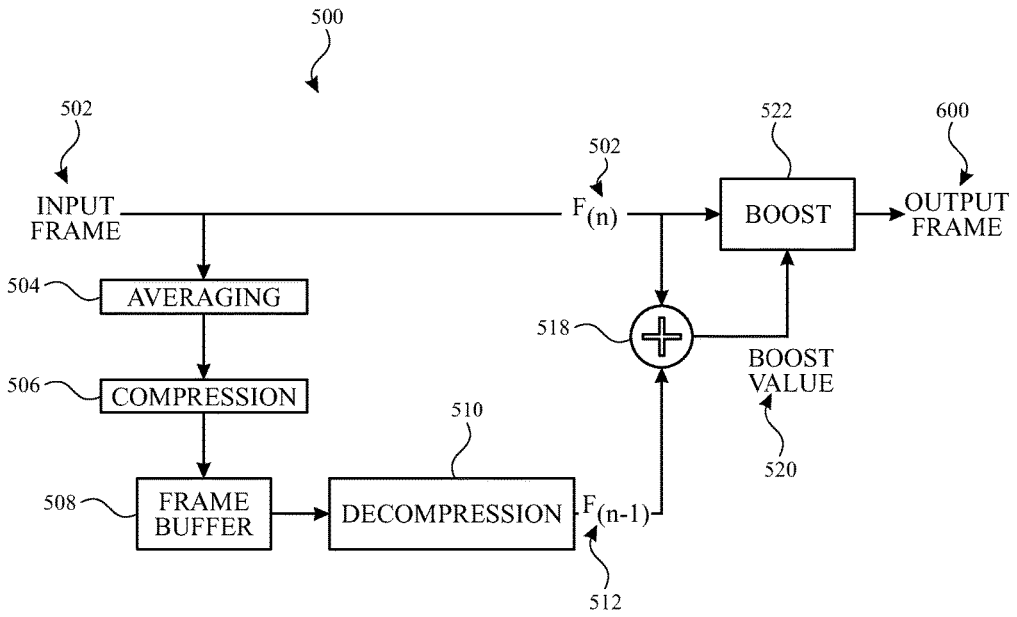
FIG. 6 illustrates a flow diagram for the pixel overdrive circuitry of FIG. 5 without integrated thresholding in accordance with various aspects of the subject technology.

It should also be appreciated that, although thresholding using threshold engine 516 is shown in FIG. 5 as being performed integrally with the boosting operations of boost engine 522 (e.g., boost engine 522 receives current frame 502 from threshold engine 516), thresholding can be omitted, can be performed separately from overdrive operations, or can be performed by boost engine 522 to generate an overdrive output frame 600, as shown in FIG. 6. In accordance with some aspects, a sloping mechanism for thresholding engine 516 can be used to smooth out the overdrive decision in situations in which "Delta" is above but close to the threshold. Applying sloping to the thresholding operations in this way may provide a smoother start to overdrive applications in these situations.

Figure 7:
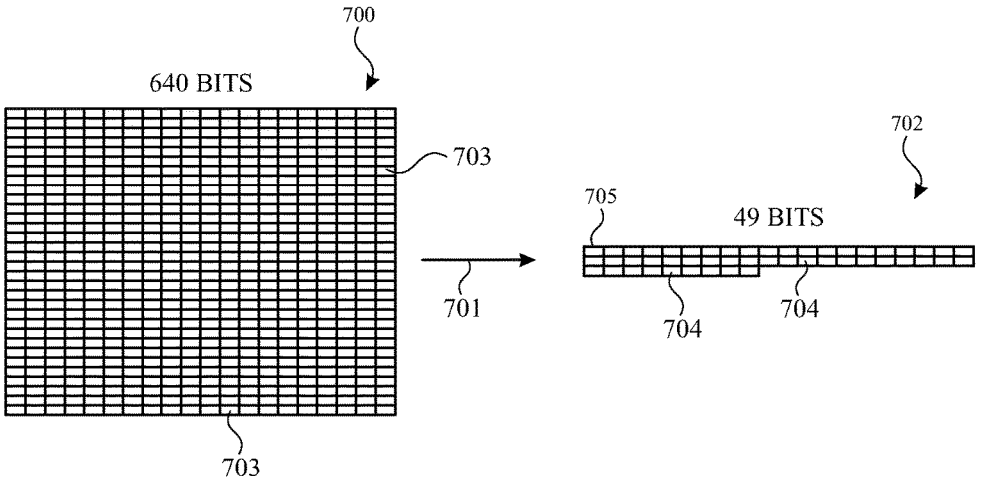
FIG. 7 illustrates an exemplary data compression in accordance with various aspects of the subject technology.

FIG. 7 shows an exemplary compression of data for a single tile, for a single color, in this exemplary scenario from a data block 700 having six-hundred-forty bits 703 to a compressed data block 702 having forty-nine bits 704 (e.g., a compression ratio of approximately 13:1). A first bit 705 of data block 702 may be an indicator bit that indicates the type of encoding used to compress data block 700 into data block 702. For example, bit 705 may have a first value that indicates that data block 702 has been compressed using decimation encoding or a second value that indicates that block 702 has been compressed using gradient encoding.

Figure 8:
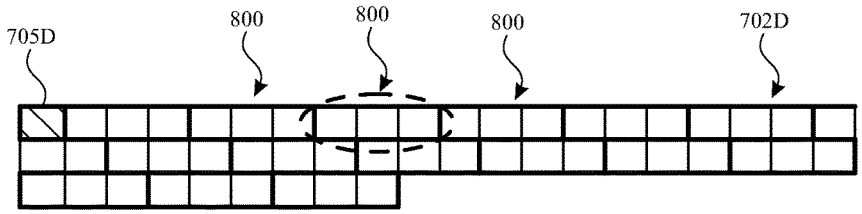
FIG. 8 illustrates an exemplary data compression operation using decimation encoding in accordance with various aspects of the subject technology.
Figure 9:
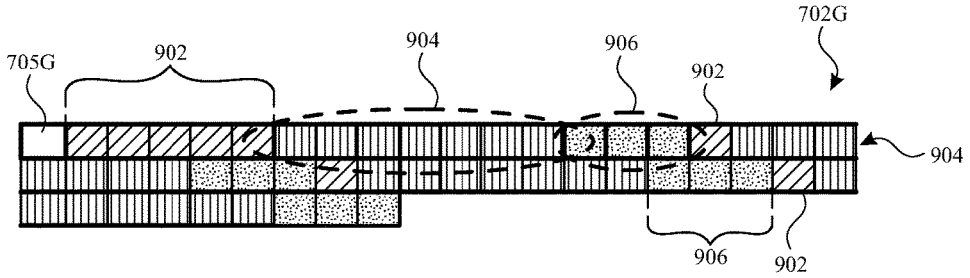
FIG. 9 illustrates an exemplary data compression operation using gradient encoding in accordance with various aspects of the subject technology.

FIGS. 8 and 9 show examples of decimation encoding and gradient encoding in accordance with aspects of the subject disclosure. As shown in FIG. 8, for a decimation-encoded block 702D, a decimation indicator bit 705D may indicate the decimation encoding, and the remaining bits may include a group 800 of three bits each for each two-by-two subpixel block in the tile. Each group 800 of three bits may be the three most significant bits for that two-by-two subpixel block.

For a gradient-encoded block 702G, a gradient indicator bit 705G may indicate the gradient encoding, and in the remaining bits, each line of a four-by-four array of averaged two-by-two subpixel blocks of an eight-by-eight subpixel tile may be encoded using seven bits 904 to encode the first subpixel in a line, and three bits 906 to encode the gradient across the remaining subpixels in that line. In this way, the tile can be encoded in forty bits if the gradient is encodable.

Figure 10:
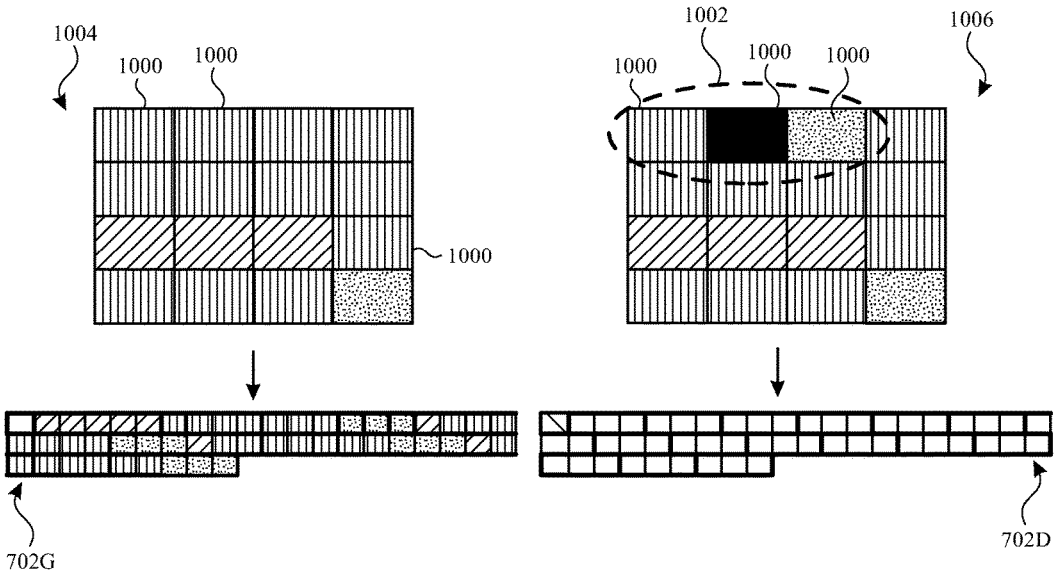
FIG. 10 illustrates an exemplary data compression operation including a selection of decimation encoding or gradient encoding in accordance with various aspects of the subject technology.

FIG. 10 shows examples of four-by-four averaged tiles 1004 and 1006 of subpixel block values 1000, tiles 1004 and 1006 being, respectively, encodable and unencodable. In the example of averaged tile 1004, averaged subpixel block values 1000 (e.g., values corresponding to averaged two-by-two subpixel blocks from averaging engine 504) have a gradient across each line that is encodable with the number of available bits (e.g., one bit in the example of FIG. 9) to form an encoded data block 702G. In the example of averaged tile 1006, a first group 1002 of averaged subpixel block values 1000 includes a value change having a large step, such that the gradient from the first subpixel block value in the line is not encodable with a single bit. In the example, of FIG. 10, because tile 1006 is not gradient encodable, tile 1006 is compressed using decimation encoding into decimation-encoded data block 702D.

Accordingly, FIG. 10 illustrates one example of the decision point for compression engine 506 for selecting gradient encoding or decimation encoding. In general, compression engine 506 attempts gradient encoding and, if the tile is not gradient encodable, compresses the tile using decimation encoding. It should be appreciated that, in some scenarios, a display frame may have a size (e.g., in one or more dimensions) that is not an integer multiple of eight pixels. In these scenarios, a tile size different from 8×8 may be used, or remainder pixels at the edge of the frame after 8×8 tile encoding may be compressed using decimation encoding or using a modified gradient encoding scheme specific to the dimensions of the remainder pixel block(s).

Figure 11:
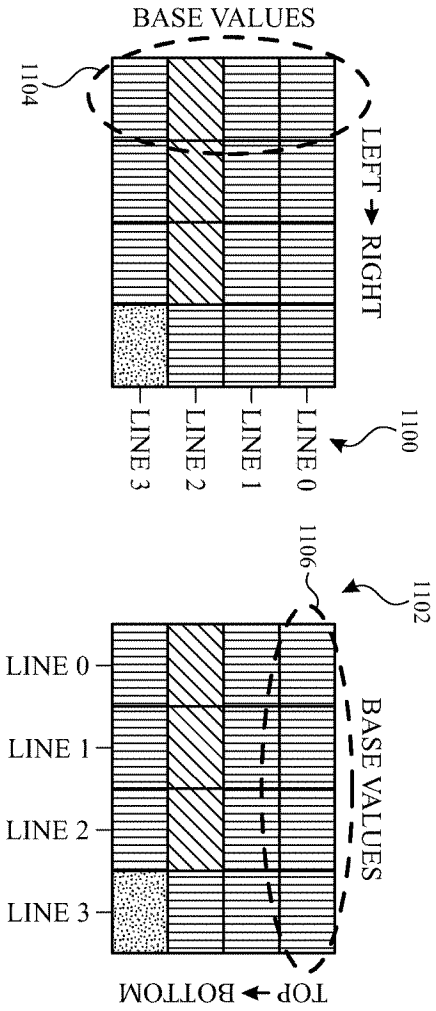
FIG. 11 illustrates various examples of gradient encoding operations in accordance with various aspects of the subject technology.

It should also be appreciated that, in attempting gradient encoding, compression engine 506 may attempt various style modifications to the gradient encoding before selecting decimation encoding. One example of a style variation on the gradient encoding is illustrated in FIG. 11. As shown in FIG. 11, gradient encoding can be a left-right gradient encoding in which the base values (e.g., the first subpixel block values encoded with the seven bits 904, for each line) for an averaged tile 1100 can be, for example, the leftmost column values 1104 in the averaged tile and the gradient is horizontal, or a top-bottom encoding for an averaged tile 1102 in which the base values for each line are, for example, the topmost row values 1106 and the gradient is vertical. Because, referring back to FIG. 9, gradient encoding using seven bits for the base values uses only 40 bits and leaves eight unused bits 902, one of the unused bits 902 can be used to indicate left-right or top-bottom encoding for each tile. Another of the eight unused bits can also be used to indicate whether the gradient for each line is an increment (e.g., an increasing gradient) or a decrement (e.g., a decreasing gradient). It should also be appreciated that right-left or bottom-top gradient encoding can also be used with increment or decrement gradient encoding.

Moreover, although seven bit gradient encoding may be desired, gradient encoding using six bits, five bits, four bits, or three bits for the base values may still be preferable to full decimation encoding. Accordingly, in addition to attempting to encode each subpixel block using seven-bit gradient encoding (e.g., seven-bit left-right and top-bottom base encoding with increment or decrement gradients), if the tile is not encodable using a seven-bit base, compression engine 506 may also attempt gradient encoding using a six-bit, five-bit, four-bit, and/or three-bit base. Gradient encoding using a six-bit base includes decimating values of the averaged block by one bit and then performing the gradient encoding on the decimated values. Gradient encoding using a five bit base includes decimating the six-bit values and then gradient encoding, etc.

Decimating the values and then gradient encoding may allow more tiles to be gradient encoded. For example, with a seven-bit base and only one bit available to encode the gradient, only an increment or decrement of one or zero can be encoded and a step of, for example, two in the gradient cannot be encoded. Accordingly, a base value of 120 and an adjacent value of 122 could not be encoded. However, decimating to six bits such that the base value is converted to 60 and the adjacent value is converted to 61 allows the step to be encoded with a single bit. Moreover, further decimation (e.g., to a five-bit, four-bit, or three-bit base) creates more unused bits for each line which can be used to encode a wider range of gradients. For example, using five-bit encoding, two bits per gradient step per line are available to encode the step and, accordingly, increments of zero, +/−1, or +/−2 can be encoded.

Moreover, the unused bits can also be used to indicate, for each line, whether and how much decimation has occurred in the gradient encoding. In this way, within a single tile, some lines can be seven-bit gradient encoded and some lines can be, for example, six-bit gradient encoded. This gradient encoding allows for single lines to use a reduced amount of decimation without reducing the complete decimation level of the tile. For example, a tile can have three lines as seven-bit decimation and one line as six-bit decimation. Six-bit encoding allows five-bit, 4-bit, and 3-bit decimation for some lines. Five-bit encoding only allows five-bit decimation within a tile, but allows for gradient steps of −1, 0, 1, and 2 or −2, −1, 0, and 1. Four-bit encoding allows for three-bit lines and gradient steps of −1, 0, 1, and 2 or −2, −1, 0, and 1.

Figure 12:
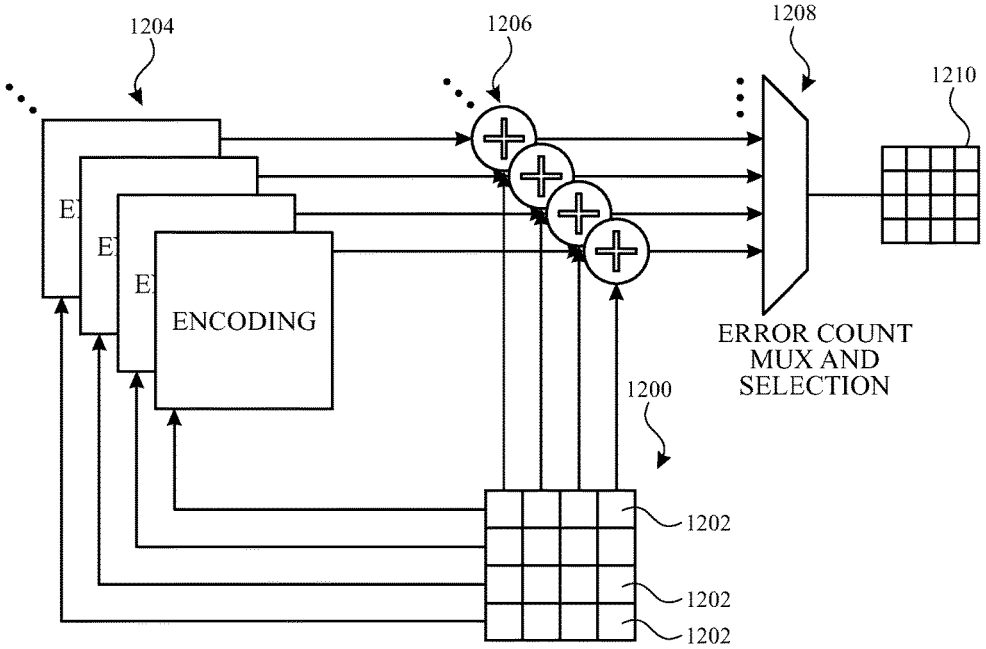
FIG. 12 illustrates a flow diagram for selection of a gradient encoding style in accordance with various aspects of the subject technology.

As indicated in FIG. 12, compression engine 506 selects a gradient compression style for each tile 1200 (e.g., having averaged 2-by-2 subpixel blocks 1202) by serially encoding the tile with each possible gradient compression style (e.g., left-right/top-down, increment/decrement, and base bit level) in an encoding operation 1204. The compression style having the least amount of decimation may be selected. For example, if one compression style does not include any decimation and another compression style includes some decimation (e.g., absolute amounts of decimation for each sub pixel), the compression style without any decimation is selected. In this way, a more accurate boost is provided because a lower decimation level results in a lower threshold. With a lower threshold, the overdriven frame will have more accurate boosting (e.g., as long as the thresholding is high enough to block maximum error).

The amount of decimation for a tile may be counted on a per line basis, as each line can have additional decimation above the decimation level of the tile. Once each tile's total decimation is counted, the compression style with the least amount of decimation is selected for that tile. In some scenarios, two possible compression styles may have equal decimation. In scenarios in which two compression styles have equal decimation, the compression style may be chosen based on a comparison of errors associated with each compression style.

For example, the comparison of errors may include comparing the difference of the original frame values decimated to seven bit values to the other encoded values to determine an error level for each gradient encoding style in a comparison operation 1206. The comparison also accounts for rounding of values due to decimation. For example, if a starting value is twenty-three in 7-bits, and in 5-bits has two least significant bits (LSB's) that are zero so that the decimated 5-bit value becomes twenty, for the comparison, two is added in order to round the decimation result due to the two-bit decimation, thus comparing a 7-bit value of twenty-three to a rounded 5-bit value of twenty-two.

Compression engine 506 continues selecting the gradient compression style by identifying the gradient encoding style having the smallest error in multiplexing and selection operations 1208, and outputting a data block corresponding to a compressed tile 1210 that is gradient encoded using the smallest-error style. The data block corresponding to a compressed tile 1210 that is gradient encoded using the smallest-error style includes bit values that indicate the style used. Compression engine 506 may include tile storage for storing a single tile for determining which encoding style to be used for that tile. If none of the gradient encoding styles is able to encode the tile, the tile is compressed using decimation encoding and the decimation indicator bit is set.

Accordingly, for each tile of the current frame, compression engine 506 first attempts gradient compression (e.g., including attempting each of the gradient compression styles described herein), and outputs a gradient-compressed tile if gradient encoding is achieved or outputs a decimation-encoded tile if gradient compression cannot be achieved using any of the possible gradient compression styles. The compressed tile is then provided to frame buffer 508 to replace the previously stored compressed-frame tiles for a subsequent pixel overdrive operation (as described above in connection with FIG. 5) for the next display frame.

As noted above, because the gradient compression operations are based on successively decimated data, a maximum possible compression error for each tile is always known (based on the number of decimated bits). For example, for a 10-bit display frame, the maximum error is +3/−4 bits using seven-bit gradient encoding and +63/−64 bits using decimation encoding with three bits. As described above in connection with FIG. 5, threshold engine 516 determines whether pixel overdrive should be performed for each subpixel by determining whether the Delta between the current and previous frame (for that subpixel) is larger than this known maximum possible error (thus indicating that overdriving can be performed without visible artifacts).

As also described above in connection with FIG. 5, boost engine 522 receives boost values 520 based on the comparison of the decompressed previous frame and the uncompressed current frame, and generates overdrive output frame 524 by adding the boost values to the current frame. Boost values 520 may be determined (e.g., by comparator 518 or by boost engine 522 if the raw comparison of the frames is provided to boost engine 522) using a delta-centric lookup table that ensures that the boost value is always zero when the frame difference (Delta) is zero.

Figure 13:
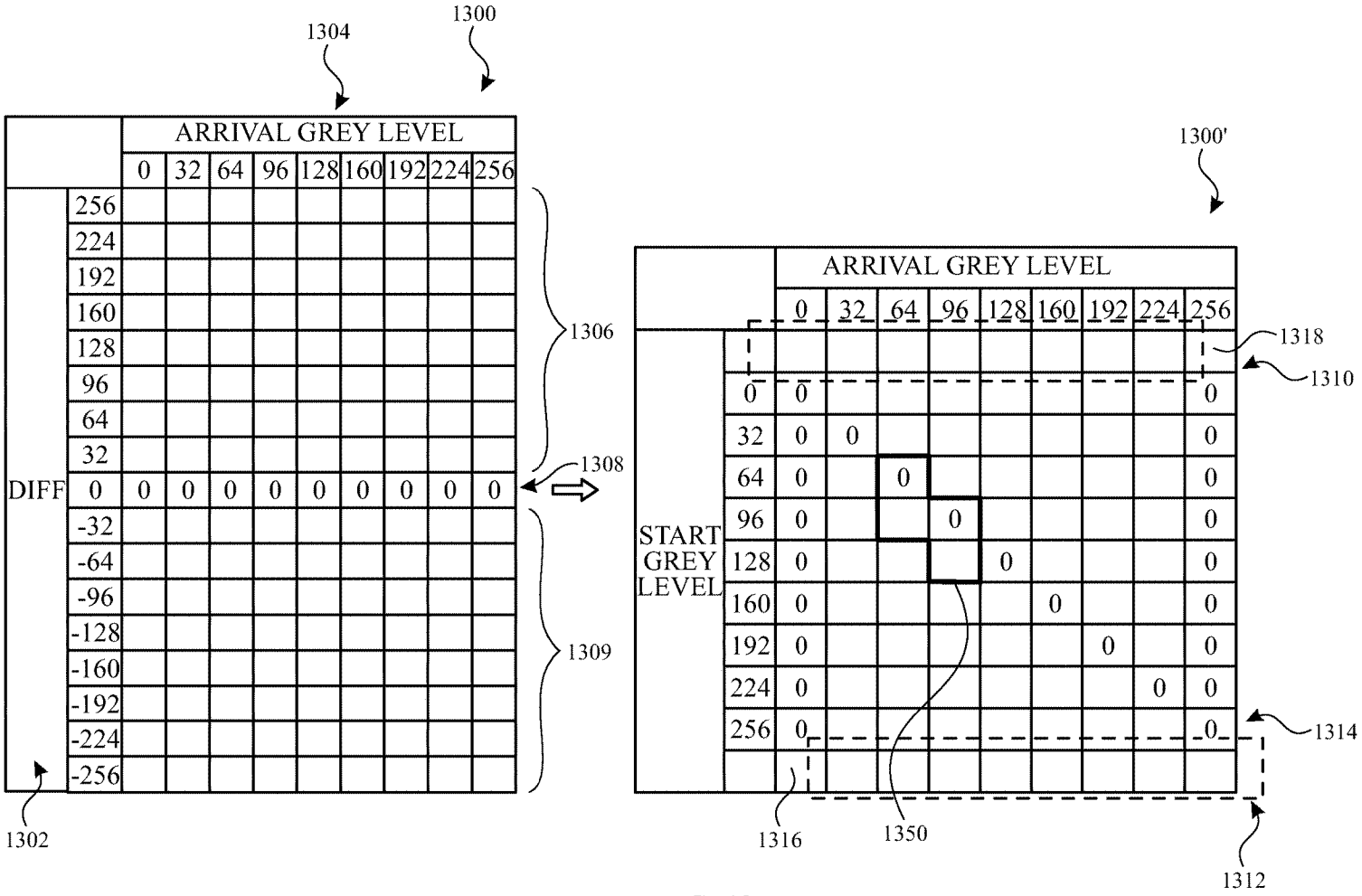
FIG. 13 illustrates exemplary look-up tables for determining a pixel overdrive boost value in accordance with various aspects of the subject technology.

Examples of delta-centric lookup tables are shown in FIG. 13. In the example of FIG. 13, delta-centric lookup table 1300 includes a first axis 1302 corresponding to the difference between the current and previous frame and a second axis 1304 corresponding to the arrival grey level (e.g., the grey level of the current frame to be displayed). As shown, the difference axis is larger than the arrival grey level axis and all of the entries along the row 1308 corresponding to zero difference are zero. The row 1308 of zero entries separates entries 1306 for positive frame difference values from entries 1309 for negative frame difference values.

The boost value may be an interpolation (e.g., a bilinear interpolation) of several values of the lookup table around the location of the current difference and arrival grey level. In the example of lookup table 1300, a bilinear interpolation of the values of a square group of lookup table values at the difference and arrival grey levels of the current frame are used. However, in order to further reduce the storage needed by overdrive circuitry 500, lookup table 1300 can be modified (e.g., using a 45 degree rotation of the table values) to generate compressed lookup table 1300' having a first axis corresponding to the start grey level (e.g., the grey level of the previous display frame) and a second axis corresponding to the arrival grey level as in table 1300.

Groups of table values from table 1300', to be interpolated to determine each boost value, are non-square. For example, a non-square group 1350 of table values may be selected and interpolated to determine the boost value such that non-square group 1350 generates the same result as a square group of table 1300, but with less storage required. In order to select the correct four entries of table 1300' for interpolation to generate a particular boost value (e.g., to select the entries of group 1350), a modulo operation may be performed. For example, the column index of a base table entry for the boost value may be determined based on the arrival grey level. The row index of the base table entry may be determined based on a comparison of the start grey level, modulo a predetermined value, with the arrival grey level, modulo the predetermined value. Once the base table entry row and column indices are determined in this way, the other table entries to be interpolated with the base table entry may be obtained by decrementing the row index of the base table value, incrementing the column index of the base table entry, and incrementing both the row index and the column index of the base table entry (for example).

As shown in FIG. 13, compressed lookup table 1300' includes unused cells 1316 and 1318 in the top and bottom rows 1312 and 1310. Moreover, bottom row 1312 and top row 1310 are not associated with a start grey level value, but are included to extend the first axis to accommodate selection of the non-square group of values of the type shown in group 1350. As shown, the diagonal 1314 of the portion of table 1300' between top and bottom rows 1310 and 1312 includes only zero entries that ensure that zero difference between frames results in zero boost.

In accordance with various aspects of the subject disclosure, an electronic device with a display is provided, the electronic device including a frame buffer configured to store a compressed display frame that is a preceding display frame to a current display frame. The electronic device also includes a threshold engine configured to determine, without compressing or decompressing the current display frame, whether to perform an overdrive operation for the current display frame based on a compression error for the compressed preceding display frame and based on a comparison of an averaged version of the current display frame to a decompressed version of the compressed preceding display frame. The electronic device also includes a boost engine configured to generate, if it is determined by the threshold engine that the overdrive operation is to be performed for the current display frame, an overdriven output frame by applying a boost value to the current display frame. The boost value is based on a comparison of the current display frame to the decompressed version of the compressed preceding display frame without compressing or decompressing the current display frame.

In accordance with other aspects of the subject disclosure, a method of operating a display of an electronic device is provided, the method including storing a compressed previous display frame in a frame buffer. The method also includes determining whether to perform an overdrive operation for a current display frame based on a compression error for the compressed previous display frame and based on a comparison of an averaged version of the current display frame to a decompressed version of the compressed previous display frame. The method also includes generating an overdriven output frame, if it is determined that the overdrive operation is to be performed for the current display frame, by applying a boost value to the current display frame. The boost value is based on a comparison of the current display frame to the decompressed version of the compressed previous display frame without compressing or decompressing the current display frame.

In accordance with other aspects of the subject disclosure, a non-transitory machine-readable storage medium is provided that includes instructions stored therein, which when executed by a processor, causes the processor to perform operations that include storing a compressed previous display frame in a frame buffer. The operations also include determining whether to perform an overdrive operation for a current display frame based on a known maximum compression error for the compressed previous display frame and based on a comparison of an averaged version of the current display frame to a decompressed version of the compressed previous display frame. The operations also include generating an overdriven output frame, if it is determined that the overdrive operation is to be performed for the current display frame, by applying a boost value to the current display frame. The boost value is based on a comparison of the current display frame to the decompressed version of the compressed previous display frame without compressing or decompressing the current display frame.

In accordance with other aspects of the subject disclosure, display overdrive circuitry is provided that includes processing circuitry configured to generate an overdrive output frame for display based on a received current display frame. The display overdrive circuitry also includes a frame buffer configured to store a compressed previous frame for use in generating the overdrive output frame for the current display frame. The current display frame and the previous display frame each includes, in one illustrative example, at least 5120 by 2880 pixel values, each having three colors encoded with ten bits per color, and the frame buffer has, in this illustrative example, a storage size of less than 40 megabits.

In accordance with other aspects of the subject disclosure, display overdrive circuitry is provided that includes a boost engine configured to apply a boost value to at least a portion of a current display frame to generate an overdriven output frame for display by an array of display pixels. The display overdrive circuitry also includes memory storing a lookup table. The boost value is a value that is an interpolation of a non-square group of values of the lookup table.

Various functions described above can be implemented in digital electronic circuitry, in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Some implementations include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, ultra density optical discs, any other optical or magnetic media, and floppy disks. The computer-readable media can store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself.

As used in this specification and any claims of this application, the terms "computer", "processor", and "memory" all refer to electronic or other technological devices. These terms exclude people or groups of people. For the purposes of the specification, the terms "display" or "displaying" means displaying on an electronic device. As used in this specification and any claims of this application, the terms "computer readable medium" and "computer readable media" are entirely restricted to tangible, physical objects that store information in a form that is readable by a computer. These terms exclude any wireless signals, wired download signals, and any other ephemeral signals.

To provide for interaction with a user, implementations of the subject matter described in this specification can be implemented on a computer having a display device as described herein for displaying information to the user and a keyboard and a pointing device, such as a mouse or a trackball, by which the user can provide input to the computer. Other kinds of devices can be used to provide for interaction with a user as well; for example, feedback provided to the user can be any form of sensory feedback, such as visual feedback, auditory feedback, or tactile feedback; and input from the user can be received in any form, including acoustic, speech, or tactile input.

Many of the above-described features and applications are implemented as software processes that are specified as a set of instructions recorded on a computer readable storage medium (also referred to as computer readable medium). When these instructions are executed by one or more processing unit(s) (e.g., one or more processors, cores of processors, or other processing units), they cause the processing unit(s) to perform the actions indicated in the instructions. Examples of computer readable media include, but are not limited to, CD-ROMs, flash drives, RAM chips, hard drives, EPROMs, etc. The computer readable media does not include carrier waves and electronic signals passing wirelessly or over wired connections.

In this specification, the term "software" is meant to include firmware residing in read-only memory or applications stored in magnetic storage, which can be read into memory for processing by a processor. Also, in some implementations, multiple software aspects of the subject disclosure can be implemented as sub-parts of a larger program while remaining distinct software aspects of the subject disclosure. In some implementations, multiple software aspects can also be implemented as separate programs. Finally, any combination of separate programs that together implement a software aspect described here is within the scope of the subject disclosure. In some implementations, the software programs, when installed to operate on one or more electronic systems, define one or more specific machine implementations that execute and perform the operations of the software programs.

A computer program (also known as a program, software, software application, script, or code) can be written in any form of programming language, including compiled or interpreted languages, declarative or procedural languages, and it can be deployed in any form, including as a stand alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

It is understood that any specific order or hierarchy of blocks in the processes disclosed is an illustration of example approaches. Based upon design preferences, it is understood that the specific order or hierarchy of blocks in the processes may be rearranged, or that all illustrated blocks be performed. Some of the blocks may be performed simultaneously. For example, in certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

The predicate words "configured to", "operable to", and "programmed to" do not imply any particular tangible or intangible modification of a subject, but, rather, are intended to be used interchangeably. For example, a processor configured to monitor and control an operation or a component may also mean the processor being programmed to monitor and control the operation or the processor being operable to monitor and control the operation. Likewise, a processor configured to execute code can be construed as a processor programmed to execute code or operable to execute code A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

The word "example" is used herein to mean "serving as an example or illustration." Any aspect or design described herein as "example" is not necessarily to be construed as preferred or advantageous over other aspects or design.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. An electronic device with a display, the electronic device comprising:

a frame buffer configured to store a compressed display frame that is a preceding display frame to a current display frame;

a threshold engine configured to determine whether to perform an overdrive operation for the current display frame based on a compression error for the compressed preceding display frame and based on a comparison of an averaged version of the current display frame that is an original uncompressed version to a decompressed version of the compressed preceding display frame; and a boost engine configured to generate, if it is determined by the threshold engine that the overdrive operation is to be performed for the current display frame, an overdriven output frame by applying a boost value to the current display frame that is an original uncompressed version, wherein the boost value is based on a comparison of the current display frame that is an original uncompressed version to the decompressed version of the compressed preceding display frame.

2. The electronic device of claim 1, further comprising a compression engine configured to compress the preceding display frame and provide the compressed preceding display frame to the frame buffer.

3. The electronic device of claim 2, wherein the preceding display frame comprises an array of pixel values, and wherein the compression engine is configured to compress the preceding display frame at least in part by determining, for each of a plurality of tiles of the array of pixel values, whether to compress that tile using gradient encoding or decimation encoding.

4. The electronic device of claim 3, wherein the compression engine is configured to determine whether to compress each tile using gradient encoding or decimation encoding by:

attempting to compress each tile of the preceding display frame using gradient encoding;

compressing that tile using gradient encoding if the attempt to compress that tile using gradient encoding is successful; and compressing that tile using decimation encoding if the attempt to compress that tile using gradient encoding fails.

5. The electronic device of claim 4, wherein attempting to compress each tile of the preceding display frame using gradient encoding comprises attempting to compress at least one tile by:

attempting to encode a leftmost column of the at least one tile as a base, using a first number of bits, and to encode a gradient for each row of the at least one tile as increments or decrements from the base; and attempting to encode a topmost row of the at least one tile as the base, using the first number of bits, and to encode a gradient for each column of the at least one tile as increments or decrements from the base.

6. The electronic device of claim 5, wherein, if the at least one tile cannot be encoded using the leftmost column or the topmost row as a base using the first number of bits, encoding at least one row or column of the at least one tile by encoding a base value for that row or column using a second number of bits that is less than the first number of bits.

7. The electronic device of claim 6, wherein the compression error is a known maximum compression error for the preceding display frame that is known, for at least a portion of the at least one tile, based on the second number of bits.

8. The electronic device of claim 4, wherein compressing that tile using gradient encoding if the attempt to compress that tile using gradient encoding is successful comprises compressing that tile by encoding a first row of that tile using a first number of bits to encode a base for the first row and encoding a second row of that tile using a second number of bits, different from the first number of bits, to encode a base for the second row.

9. A method of operating a display of an electronic device, the method comprising:

storing a compressed previous display frame in a frame buffer;

determining whether to perform an overdrive operation for a current display frame based on a compression error for the compressed previous display frame and based on a comparison of an averaged version of the current display frame that is an original uncompressed version to a decompressed version of the compressed previous display frame; and generating an overdriven output frame, if it is determined that the overdrive operation is to be performed for the current display frame, by applying a boost value to the current display frame that is an original uncompressed version, wherein the boost value is based on a comparison of the current display frame that is an original uncompressed version to the decompressed version of the compressed previous display frame.

10. The method of claim 9, further comprising compressing the previous display frame and providing the compressed previous display frame to the frame buffer.

11. The method of claim 10, wherein the previous display frame comprises an array of pixel values, and wherein compressing the previous display frame comprises determining, for each of a plurality of tiles of the array of pixel values, whether to compress that tile using gradient encoding or decimation encoding.

12. The method of claim 11, wherein determining whether to compress each tile using gradient encoding or decimation encoding comprises:

attempting to compress each tile of the previous display frame using gradient encoding;

compressing that tile using gradient encoding if the attempt to compress that tile using gradient encoding is successful; and compressing that tile using decimation encoding if the attempt to compress that tile using gradient encoding fails.

13. The method of claim 12, wherein attempting to compress each tile of the previous display frame using gradient encoding comprises attempting to compress at least one tile by:

attempting to encode a leftmost column of the at least one tile as a base, using a first number of bits, and to encode a gradient for each row of the at least one tile as increments or decrements from the base; and attempting to encode a topmost row of the at least one tile as the base, using the first number of bits, and to encode a gradient for each column of the at least one tile as increments or decrements from the base.

14. The method of claim 13, wherein, if the at least one tile cannot be encoded using the leftmost column or the topmost row as a base using the first number of bits, encoding at least one row or column of the at least one tile by encoding a base value for that row or column using a second number of bits that is less than the first number of bits.

15. The method of claim 14, wherein the compression error for the previous display frame is a known maximum compression error that is known, for at least a portion of the at least one tile, based on the second number of bits.

16. The method of claim 12, wherein compressing that tile using gradient encoding if the attempt to compress that tile using gradient encoding is successful comprises compressing that tile by encoding a first row of that tile using a first number of bits to encode a base for the first row and encoding a second row of that tile using a second number of bits, different from the first number of bits, to encode a base for the second row.

17. A non-transitory machine-readable storage medium comprising instructions stored therein, which when executed by a processor, causes the processor to perform operations comprising:

storing a compressed previous display frame in a frame buffer;

determining whether to perform an overdrive operation for a current display frame based on a known maximum compression error for the compressed previous display frame and based on a comparison of an averaged version of the current display frame that is an original uncompressed version to a decompressed version of the compressed previous display frame; and generating an overdriven output frame, if it is determined that the overdrive operation is to be performed for the current display frame, by applying a boost value to the current display frame that is an original uncompressed version, wherein the boost value is based on a comparison of the current display frame that is an original uncompressed version to the decompressed version of the compressed previous display frame.

18. The non-transitory machine-readable storage medium of claim 17, wherein the operations further comprise decompressing the compressed previous display frame.

19. The non-transitory machine-readable storage medium of claim 17, wherein the operations further comprise compressing the current display frame for use during an overdrive operation for a subsequent display frame.

20. The non-transitory machine-readable storage medium of claim 17, wherein the operations further comprise compressing the previous display frame, in part, by determining whether to encode each of a plurality of tiles of the previous display frame using gradient encoding or decimation encoding.

21. Display overdrive circuitry, comprising:

a boost engine configured to apply a boost value to at least a portion of a current display frame to generate an overdriven output frame for display by an array of display pixels; and memory storing a compressed lookup table to reduce storage needed by the display overdrive circuitry, wherein the boost value comprises a value that is an interpolation of a non-square group of values of the compressed lookup table.

22. The display overdrive circuitry of claim 21, wherein the compressed lookup table comprises:

a plurality of rows along a first axis, each corresponding to a grey level of a previous display frame;

a first additional row above the plurality of rows; and a second additional row below the plurality of rows, wherein the first and second additional rows extend the first axis to accommodate selection of the non-square group of values.

23. The display overdrive circuitry of claim 22, wherein the first and second additional rows each include an unused table cell.

24. The display overdrive circuitry of claim 21, wherein the boost engine is configured to identify the non-square group of values of the compressed lookup table based on a modulo operation.

* * * * *